United States Patent [19]

Schlosser

[11] 4,166,410

[45] Sep. 4, 1979

[54] PNEUMATIC MOTOR

[75] Inventor: Paul W. Schlosser, Houston, Tex.

[73] Assignee: Edward Bleiweiss, Houston, Tex.

[21] Appl. No.: 836,586

[22] Filed: Sep. 26, 1977

[51] Int. Cl.[2] ..... F01L 25/04; F01L 23/00

[52] U.S. Cl. ..... 91/50; 91/290; 91/303; 91/341 R; 92/85 R

[58] Field of Search ..... 91/50, 341, 290, 399, 91/303; 92/85 R

[56] References Cited

U.S. PATENT DOCUMENTS

| | | | |
|---|---|---|---|
| 2,821,170 | 1/1958 | Jacobus | 92/85 R |
| 3,079,900 | 3/1963 | Hunnicutt | 91/290 |
| 3,726,185 | 4/1973 | Prr | 91/303 |
| 4,074,612 | 2/1978 | Miller | 91/303 |

FOREIGN PATENT DOCUMENTS

| | | | |
|---|---|---|---|
| 323303 | 1/1920 | United Kingdom | 91/50 |
| 511441 | 10/1976 | U.S.S.R. | 91/50 |

*Primary Examiner*—Paul E. Maslousky

*Attorney, Agent, or Firm*—Hill, Van Santen, Steadman, Chiara & Simpson

[57] ABSTRACT

A reciprocating piston motor has the piston biased in return stroke direction and driven in power stroke by air pressure introduced between the head of the piston and a closure across the end of the working chamber cylinder. A valve which closes an exhaust port leading from the working chamber, is opened at the end of the power stroke by working chamber air pressure and the air pressure is evacuated from the working chamber. The valve is returned to closing relation to the port by the returning piston, thereby resetting the motor for another cycle of operation.

7 Claims, 1 Drawing Figure

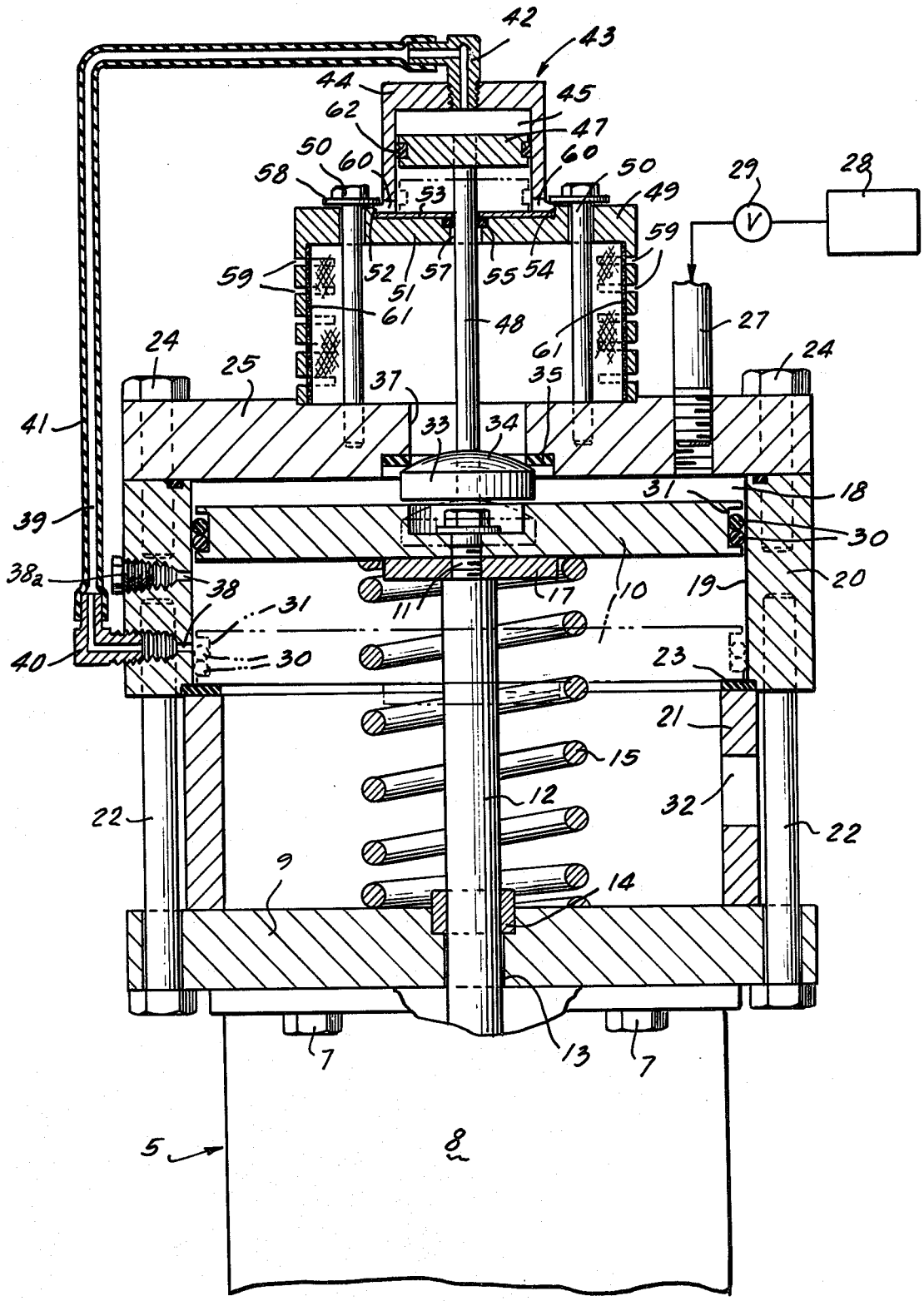
42
43
44
45
62
47
50
60
60
50
58
53
49
29
28
V
59
59
52
51
57
55
54
61
48
27
61
24
24
25
37
35
41
33
34
31
18
39
30
38a
38
10
19
20
11
17
31
40
30
23
21
15
12
32
22
22
9
14
13
7
7
5
8

PNEUMATIC MOTOR

This invention relates in general to pneumatic motors, and is more particularly concerned with a new and improved reciprocating piston motor.

Cycling of pneumatic reciprocating motors has always presented a problem, particularly where automatic cycling is desired such as for the operation of pumping apparatus. In general, complex valving expedients have been employed. Difficulty has been experienced in attaining positive cycling control, especially where operating conditions demand a wide range of cycling speed capability.

An important object of the present invention is to overcome the disadvantages, drawbacks, inefficiencies, shortcomings, and problems inherent in prior pneumatic motors, and particularly motors of this type for driving pumping apparatus.

Another object of the invention is to provide a new and improved pneumatic motor of the reciprocating piston type having novel cycle controlling means.

According to features of the invention there is provided in combination in a self-cycling pneumatic motor a reciprocable piston having a head at one end and a piston rod extending from its opposite end and adapted to be connected to a member to be driven by the piston, a hollow cylinder providing a working chamber in which the piston is reciprocable in working and return strokes, a closure at one end of the working chamber, and the opposite end of the working chamber being open to atmosphere, said piston head facing toward said closure, means normally biasing the piston in return stroke direction toward said closure, means for delivering piston driving air under pressure into said working chamber between said closure and the piston head to drive the piston in a power stroke in opposition to said biasing means, said closure having an exhaust port with a valve seat at the working chamber end of the port, a valve member normally baised in closing relation against said seat by air pressure in the working chamber, means activated by air pressure from within the working chamber after the piston has substantially reached the end of the power stroke for unseating said valve member for exhausting air pressure from the working chamber to release the piston for biased return stroke, and said valve member being returned to said seat by the piston at substantially the end of the return stroke so that air pressure delivered by said delivering means into the working chamber can drive the piston in another power stroke.

Other objects, features and advantages of the invention will be readily apparent from the following description of a certain representative embodiment thereof, taken in conjunction with the accompanying drawing although variations and modifications may be effected without departing from the spirit and scope of the novel concepts embodied in the disclosure and in which:

The FIGURE depicts in longitudinal sectional view a pneumatic motor embodying features of the invention.

A pneumatic motor in accordance with the present invention is well adapted to drive a high pressure piston pump 5 which may be of the type covered in my issued U.S. Pat. No. 4,029,442 dated June 14, 1977, and to any extent necessary that patent is incorporated herein by reference. By means of bolts 7 a casing 8 housing the pump 5 is attached to a base plate 9 which may comprise an end closure for the housing 8 and also serves as a mounting plate for the pneumatic motor.

In a preferred embodiment, the pneumatic motor comprises a reciprocating piston 10 to one side of which is attached as by means of a bolt 11 a piston shaft or rod 12 which extends through a port 13 in the base plate 9. A reciprocation guide bearing 14 in the port 13 maintains the reciprocating piston rod 12 steady. Diameter of the motor piston 10 will depend upon the power ratio desired in the pump and motor assembly.

Cycling of the piston 10 is effected by means of air pressure in a power stroke and by means of a coiled compression biasing spring 15 in return stroke. For this purpose the spring 15 is selected to be of a size and thrust force capacity suitable for the size, speed, suction resistance, and other factors involved in the pump to be driven by the motor. At one end the biasing return spring 15 thrusts against the plate 9 and at its other end the spring thrusts against the piston rod side of the piston 10 about a centering washer disk 17 concentric with the rod 12. At its opposite, free end, the piston 10 is adapted to be exposed to power stroke driving air pressure in a working chamber 18 defined within a cylindrical inner wall 19 of a cylinder housing 20 of adequate length to accommodate the length of power stroke desired for the piston 10. In this instance the cylinder housing 20 comprises a ring-shaped member resting at its inner end against one end of a combination spacer and stroke limiting ring 21 which at its opposite end rests against the plate 9, the assembly being secured together by means of bolts 22. A shock absorbing resilient annular bumper 23 is mounted on the end of the ring 21 which provides a stroke limiting shoulder opposing the piston 10.

Across the outer end of the working chamber 18, the cylinder housing 20 has secured thereto as by means of bolts 24 a closure plate 25. Air under suitable pressure, e.g. 100, psi is delivered to the working chamber 18 between the piston 10 and the closure plate 25 by means of a duct 27 connected with a suitable source 28 of air under pressure such as a compressed air tank or compressor. A valve 29 may be provided in the duct 27 for controlling the air pressure and may embody the dual functions of a shut-off valve and a throttle valve. The compressed air, which for automatic, self-cycling purposes is supplied continuously during any desired length of working period of the motor, drives the piston 10 in a power stroke in opposition to bias of the spring 15 between the full line position shown in the drawing and the dash line position. Leakage of air from the working chamber 18 past the piston 10 is substantially prevented by sealing means preferably comprising a pair of O-rings 30 seated in a groove 31 in the perimeter of the piston 10 and sealingly engaging the cylinder wall 19. The back of the piston 10, that is the side from which the piston rod 12 extends, is desirably open to atmosphere as for example, through one or more ports 32 in the spacer and stop ring 21. As the piston 10 is driven in a power stroke, the return spring 15 is compressively loaded for returning the spring to starting position for recycling.

Means actuated by air pressure from within the working chamber 18 are provided for releasing the piston 10 from driving air pressure after the piston reaches substantially the end of its power stroke. In a preferred form such means comprise a popoff valve 33 in the form of a disk desirably having a convex face 34 presenting an annular margin engageable with a preferably cushioning valve seat 35 about the working chamber end of an exhaust port 37 in the closure plate 25 and preferably concentric with the piston 10. Air pressure confined within the working chamber 18 normally maintains the control valve 33 seated on the seat 35 in closing relation to the port 37, whereby the full force of compressed air in the working chamber 18 is adapted to drive the piston 10 in its power stroke toward the cushioned seat 23.

Upon the piston 10 reaching the end of its power stroke, pressure bleed-off from the working chamber 18 initiates unseating of the control valve 33 whereby to open the port 37 and permit substantial exhausting of the air pressure from within the working chamber 18 and return of the piston to starting position. For this purpose, a selected bleed-off port 38 located in the wall of the cylinder housing 20 is exposed for bleeding air pressure from within the working chamber 18 when the piston 10 reaches substantially the end of the desired length of power stroke. To enable selection of piston stroke length for proportional pumping, for example, the port 38 which is shown nearest the seat bumper 23 permits maximum stroke length and the port 38 which is shown nearest the closure 25 permits only half the stroke length. Whichever of the plurality of selected ports 38 is not in use is closed by means of a plug 38*a*. Any other desired relative disposition of the ports 38, may, of course, be provided.

The O-ring seals 30 are dimensioned to occupy less than the full width of the groove 31, and as the piston 10 reaches the bleed-off port 38 the O-ring 30 nearest the piston rod side of the piston passes the port 38 while the O-ring 30 nearest the pressure head side of the piston maintains a sealed relationship about the piston. Thereby escape of compressed air to the port 38 is prevented until the first O-ring 30 has passed the port 38, whereafter the second O-ring 30 follows past the port 38 and pressure air can escape from the pressure side of the piston through the groove 31 and out through the port 38. This arrangement of the O-rings is highly desirable to prevent stalling of the piston.

From the port 38, the bled off compressed air travels by means of a passage 39 provided by means of an elbow nipple 40 communicating with the port 38 and a duct 41 connected through an elbow nipple 42 to pneumatic actuating means 43 for opening the valve 33. Desirably the nipple 42 is attached in air passage communication to the end closure of a generally cup-shaped cylinder 44 defining a working chamber 45 within which a piston 47 is reciprocable. A valve stem 48 connects the valve 33 concentrically with the piston 47. Means for mounting the cylinder 44 comprise a generally cup-shaped exhaust muffler 49 of substantially larger diameter than the port 37 and secured fixedly to the end closure plate 25 by means of bolts 50. A platform 51 is provided by an end closure on the exhause muffler 49 and on which the cylinder 44 is mounted. An annular radially outwardly extending seating flange 52 on the cylinder 44 is received on a thin disk 53 in a recess 54 in the platform 51 and serves as a retainer for a sealing ring 55 about the valve stem 48 at a stem clearing opening 57 in the platform. Means comprising washers 58 secured by the bolts 50 secure the mounting flange 52 in place. Air under pressure delivered by the passage 39 to the working chamber 45 acts upon the piston 47 to drive it toward the valve 33 so that through the valve stem 48 the valve 33 is unseated into the working chamber 18 as indicated in dash outline. This function is aided by having the exhaust port 37 of smaller diameter than the piston 47 and the diameter of the valve 33 at least as large as that of the piston 47 so that a marginal portion of the convex valve surface 34 is exposed to the pressure in the chamber 18 about the valve seat 35. In addition, the port 37 is open to atmosphere within the muffler housing 49 which is provided with sets of muffle aperture slots 59. The valve stem side of the piston 47 is exposed to atmosphere by way of passage slots 60 in the seating end of the cylinder 44.

Upon actuation of the piston 47 and thereby popping of the valve 33 from its seat 35, evacuation of pressure in the working chamber 18 is virtually instantaneous, the air escaping through muffle screens 61 and the muffle ports 59. The rush of air from the port 37 has no effect on the valve controlling piston 47 because the muffle chamber wall 51 provides a baffle barrier sealed off from the valve stem end of the piston 47 by the stem seal 55. By having the port 38 and desirably also at least part of the passage 39 such as in the nipples 40 and 42 of relatively small, metering diameter, pressure in the working chamber 45 is held long enough during the transition from piston driving pressure in the working chamber 18 to the release of pressure by opening of the valve 33, to permit the compressively loaded return spring 15 to move the piston 10 in return direction wherein the port 38 is momentarily closed against escape of pressure from the chamber 45 whereby the valve controlling piston 47 holds the valve 33 against any tendency of the compressed air escaping from the working chamber 18 to shift the valve 33 in closing direction. Assisting in thus holding the valve 33 open is the slight frictional resistance provided by the seal 55 together with the resistance provided by a seal 62 between the perimeter of the valve controlling piston 47 and the cylindrical wall defining the working chamber 45. Accordingly, the valve 33 will remain in open position, as indicated in dash outline, from the end of the power stroke of the piston 10 until the piston 10 thrusts against the open valve 33 and under the impetus of the return spring 15 drives the valve 33 onto its seat 35, thereby closing the working chamber 18 for rebuilding of the air pressure therein for recycling the piston 10 in a power stroke. As the piston 10 returns, the O-rings 30 uncover the port 38, opening it to atmosphere whereby the valve control piston chamber 45 is relieved of pressure so that the valve 33 can be freely returned to its seat by the returning piston 10.

It will thus be apparent, that the pneumatic motor will continuously cycle in power and return strokes while a continuous supply of compressed air is delivered to the working chamber 18. Another advantage of the pump is that the ratio between the pneumatic motor pressure and pump pressure can be established to be substantially constant assuming that optimum conditions prevail in the pump and the material being pumped. For example, a thirty to one ratio between pump pressure and motor pressure may be established. Should some obstruction in the pump fluid system develop, the pneumatic motor is self-regulating in that it will automatically adjust to the condition by slower cycling or even stopping without overstressing either the pump or the motor. Moreover, by selecting the location of the port 38 or by restricting the pump outlet, or by regulating the airflow in the airline at 27 as for example by way of the valve 29, stroking speed of the piston 10 of the motor can be adjusted.

It will be understood that variations and modifications may be effected without departing from the spirit and scope of the novel concepts of this invention.

I claim as my invention:

1. In combination in a self-cycling pneumatic motor:

a reciprocable piston having a head at one end and a piston rod extending from its opposite end and adapted to be connected to a member to be driven by the piston;

a hollow cylinder providing a working chamber in which the piston is reciprocable in working and return strokes;

a closure at one end of the working chamber, and the opposite end of the working chamber being open to atmosphere;

said piston head facing toward said closure;

means normally biasing the piston in return stroke direction toward said closure;

means for delivering piston driving air under pressure into said working chamber between said closure and the piston head to drive the piston in a power stroke in opposition to said biasing means;

said closure having an exhaust port with a valve seat at the working chamber end of the port;

a valve member normally biased in closing relation against said seat by air pressure in the working chamber;

means activated by air pressure from within the working chamber after the piston has substantially reached the end of the power stroke for unseating said valve member for exhausting air pressure from the working chamber to release the piston for biased return stroke;

said valve member being returned to said seat by the piston at substantially the end of the return stroke so that air pressure delivered by said delivering means into the working chamber can drive the piston in another power stroke;

a mounting plate;

means for mounting said cylinder on the mounting plate comprising a ring having an end facing toward said piston, said ring having an opening to atmosphere;

said mounting plate having a bore therethrough for passage of the piston rod;

and a guide bearing bushing mounted in said passage in said mounting plate for accurately guiding the piston rod in said bore; and said end of said ring serving as a power stroke stop for said piston.

2. A pneumatic motor according to claim 1, wherein said means for unseating said valve comprise a pneumatic actuator, and means for activating the actuator comprising a passage communicating with a port opening into said cylinder at a selected location between said stop and said closure and exposed to working chamber pressure when the piston substantially reaches the end of a selected length of power stroke as determined by the location of said port.

3. In combination in a self-cycling pneumatic motor:

a reciprocable piston having a head at one end and a piston rod extending from its opposite end and adapted to be connected to a member to be driven by the piston;

a hollow cylinder providing a working chamber in which the piston is reciprocable in working and return strokes;

a closure at one end of the working chamber, and the opposite end of the working chamber being open to atmosphere;

said piston head facing toward said closure;

means normally biasing the piston in return stroke direction toward said closure;

means for delivering piston driving air under pressure into said working chamber between said closure and the piston head to drive the piston in a power stroke in opposition to said biasing means;

said closure having an exhaust port with a valve seat at the working chamber end of the port;

a valve member normally biased in closing relation against said seat by air pressure in the working chamber;

means activated by air pressure from within the working chamber after the piston has substantially reached the end of the power stroke for unseating said valve member for exhausting air pressure from the working chamber to release the piston for biased return stroke;

said valve member being returned to said seat by the piston at substantially the end of the return stroke so that air pressure delivered by said delivering means into the working chamber can drive the piston in another power stroke;

a mounting plate having a bore therethrough for passage of said piston rod;

a ring member formed separately from said plate and of substantial length and extending between and maintaining said mounting plate and said cylinder spaced apart, said opposite end of said working chamber opening into said ring member;

said ring member having a smaller inside diameter than the working chamber diameter, and the end of said ring adjacent to said working chamber facing toward said piston and serving as a power stroke stop for the piston;

and means securing said mounting plate to said cylinder and effecting clamping of said ring member to and between said plate and cylinder.

4. A combination according to claim 3, including a resilient bumper mounted on said end of said ring member for cushioning engagement of the piston with said ring member end.

5. In combination in a self-cycling pneumatic motor:

a reciprocable piston having a head at one end and a piston rod extending from its opposite end and adapted to be connected to a member to be driven by the piston;

a hollow cylinder providing a working chamber in which the piston is reciprocable in working and return strokes;

a closure at one end of the working chamber, and the opposite end of the working chamber being open to atmosphere;

said piston head facing toward said closure;

means normally biasing the piston in return stroke direction toward said closure;

means for delivering piston driving air under pressure into said working chamber between said closure and the piston head to drive the piston in a power stroke in opposition to said biasing means;

said closure having an exhaust port with a valve seat at the working chamber end of the port;

a valve member normally biased in closing relation against said seat by air pressure in the working chamber;

means activated by air pressure from within the working chamber after the piston has substantially reached the end of the power stroke for unseating said valve member for exhausting air pressure from the working chamber to release the piston for biased return stroke;

said valve member being returned to said seat by the piston at substantially the end of the return stroke so that air pressure delivered by said delivering means into the working chamber can drive the piston in another power stroke;

said means for unseating said valve including an air passage leading from a port opening through said cylinder and adapted to be exposed to said working chamber at substantially the end of the power stroke of said piston;

said piston having a peripheral groove within which is mounted a pair of O-rings for maintaining a sealed engagement with the cylinder;

said O-rings occupying less than the full width of said groove, so that as the piston reaches said port, the O-ring nearest the piston rod end of the piston passes the port while the O-ring nearest the pressure head end of the piston maintains a sealed relationship about the piston and escape of air pressure is prevented until the first O-ring has passed the port, whereafter the second O-ring follows past the port and pressure air can escape from the pressure head side of the piston through said groove and out through said port;

whereby stalling of the piston is prevented.

6. In combination in a self-cycling pneumatic motor:

a reciprocable piston having a head at one end and a piston rod extending from its opposite end and adapted to be connected to a member to be driven by the piston;

a hollow cylinder providing a working chamber in which the piston is reciprocable in working and return strokes;

a closure at one end of the working chamber, and the opposite end of the working chamber being open to atmosphere;

said piston head facing toward said closure;

means normally biasing the piston in return stroke direction toward said closure;

means for delivering piston driving air under pressure into said working chamber between said closure and the piston head to drive the piston in a power stroke in opposition to said biasing means;

said closure having an exhaust port with a valve seat at the working chamber end of the port;

a valve member normally biased in closing relation against said seat by air pressure in the working chamber;

means activated by air pressure from within the working chamber after the piston has substantially reached the end of the power stroke for unseating said valve member for exhausting air pressure from the working chamber to release the piston for biased return stroke;

said valve member being returned to said seat by the piston at substantially the end of the return stroke so that air pressure delivered by said delivering means into the working chamber can drive the piston in another power stroke;

means mounted on said closure over said exhaust port and providing a muffle chamber to which said port exhausts, and comprising a member having a tubular wall providing an edge mounted on said closure, said wall having aperatures therein, and muffle screen means extending across said aperatures;

said means for unseating said valve comprising a pneumatic actuator mounted on said muffle chamber means and including a piston;

and a valve stem extending from said valve through the muffle chamber and having said actuator piston connected thereto.

7. A combination according to claim 6, wherein said pneumatic actuator comprises a generally cup-shaped member having an end wall and a cylindrical wall defining a working chamber within which said actuator piston is operable, said cylindrical wall having an edge mounted on said muffle chamber means, said edge having an opening to atmosphere, means for conducting air pressure from within the working chamber through said end wall after the piston has substantially reached the end of the power stroke for driving said actuator piston toward said muffle chamber means and thereby moving said valve stem to move said valve member to open position, and means for restraining return of said actuator piston towards said end wall until said piston head returns said valve member to its seat.

* * * * *